US006137424A

United States Patent [19]

Cohen et al.

[11] Patent Number: 6,137,424

[45] Date of Patent: Oct. 24, 2000

[54] PASSIVE ROAD SENSOR FOR AUTOMATIC MONITORING AND METHOD THEREOF

[75] Inventors: Simon S. Cohen, Haifa; Oded Kafri, Beer-Sheva, both of Israel

[73] Assignee: Tracon Sysytems, Ltd., Nesher, Israel

[21] Appl. No.: 09/231,755

[22] Filed: Jan. 15, 1999

Related U.S. Application Data

[63] Continuation of application No. PCT/US97/12121, Jul. 11, 1997, which is a continuation of application No. 08/684,944, Jul. 19, 1996.

[60] Provisional application No. 60/033,742, Dec. 23, 1996.

[51] Int. Cl.[7] ..... G08G 1/01

[52] U.S. Cl. ..... 340/933; 340/937; 340/943; 348/148; 348/149; 701/117

[58] Field of Search ..... 340/933, 937, 340/943; 348/149, 148; 701/117

[56] References Cited

U.S. PATENT DOCUMENTS

| | | | |
|---|---|---|---|
| 4,360,795 | 11/1982 | Hoff | 340/38 R |
| 5,008,666 | 4/1991 | Gebert et al. | 340/936 |
| 5,041,828 | 8/1991 | Loeven | 340/937 |
| 5,057,831 | 10/1991 | Strang et al. | 340/941 |
| 5,066,950 | 11/1991 | Schweitzer et al. | 340/937 |
| 5,150,618 | 9/1992 | Bambara | 73/660 |
| 5,204,675 | 4/1993 | Sekine | 340/933 |
| 5,239,148 | 8/1993 | Reed | 200/86 A |
| 5,373,487 | 12/1994 | Crawford et al. | 367/149 |
| 5,491,475 | 2/1996 | Rouse et al. | 340/933 |
| 5,512,891 | 4/1996 | Kang | 340/941 |
| 5,554,907 | 9/1996 | Dixon | 310/339 |
| 5,586,028 | 12/1996 | Sekine et al. | 701/1 |
| 5,668,540 | 9/1997 | Bailleul et al. | 340/933 |

FOREIGN PATENT DOCUMENTS

| | | | |
|---|---|---|---|
| 2 675 610 A1 | 10/1992 | France | G08G 1/01 |
| 405 314388A | 5/1993 | Japan | G08G 1/01 |
| 89/06413 | 7/1989 | WIPO | G08G 1/02 |

OTHER PUBLICATIONS

Mizumachi, K., "Automatic License Plate Identification Number," *Proceedings 1987 Carnahan Conference on Security Technology*, pp. (Jul. 15–17, 1987).

*Primary Examiner*—Julie Lieu

*Attorney, Agent, or Firm*—Hamilton, Brook, Smith & Reynolds, P.C.

[57] ABSTRACT

An automatic traffic monitoring system for enforcing traffic laws and regulations and for general purpose traffic monitoring includes a novel passive road sensor that accurately detects the kinematics of moving vehicles. A passive road sensor includes a detector protected in an enclosure, which is embedded in a road opening, is in a continuous listening mode. When the wheels of a passing vehicle come in contact with either the road opening, the enclosure, or both, the resulting mechanical impact generates a disturbance that triggers the detector. A processor unit of the automatic traffic monitoring system records the signal sensed by the detector and analyzes its temporal characteristics to determine the precise time of impact.

27 Claims, 14 Drawing Sheets

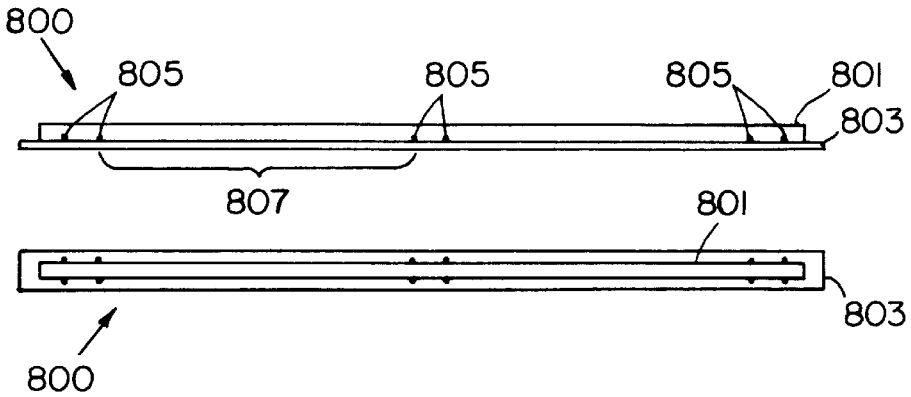
FIG. 8A
FIG. 8B
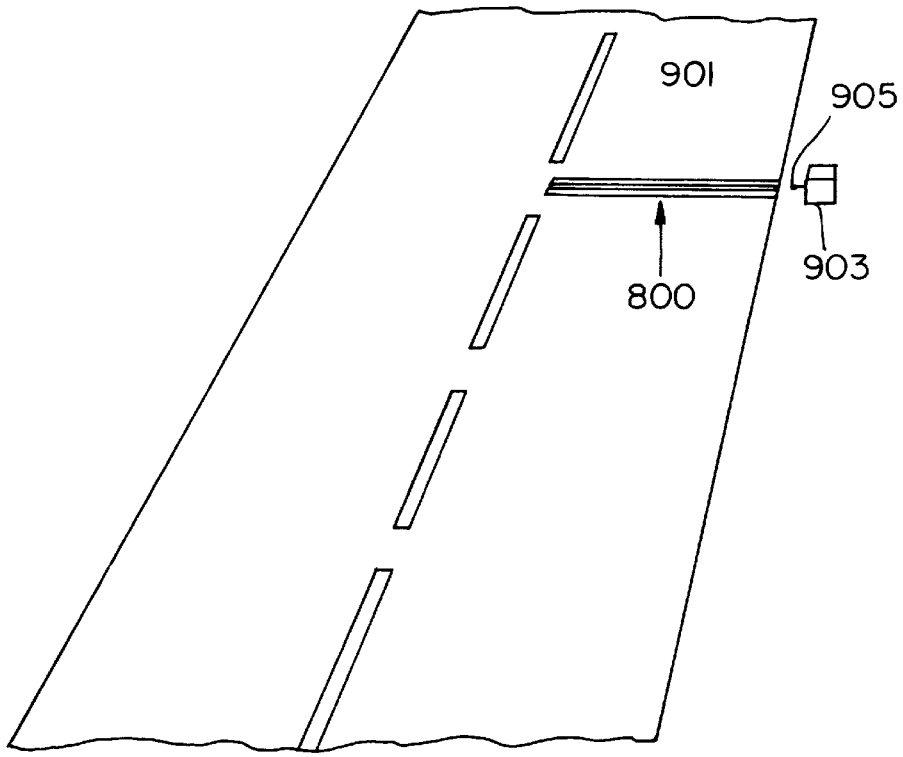
FIG. 9

PASSIVE ROAD SENSOR FOR AUTOMATIC MONITORING AND METHOD THEREOF

RELATED APPLICATIONS

This application is a continuation of and claims priority to International Application No. PCT/US97/12121, filed Jul. 11, 1997, which is a continuation in part of U.S. application Ser. No. 08/684,944 filed Jul. 19, 1996 and which claims the benefit of U.S. Provisional Application No. 60/033,742, filed Dec. 23, 1996, the contents of all the above applications are incorporated herein by reference in their entirety.

BACKGROUND OF THE INVENTION

In the modern traffic theater, it is often required to monitor and enforce traffic laws and regulations, and/or control access to restricted areas and localities. For example, monitoring vehicle's speed is of utmost importance for a safe traffic arena.

One common method for enforcing the law on highways and byways is to employ police officers who monitor traffic manually and issue citations to violators when appropriate. Police officers make use of certain electronic devices, such as a laser gun, to determine vehicles speed. Their task is often limited to enforcing speed limit and only seldom are they engaged in monitoring and enforcing other traffic laws, such as overtaking past a solid divide line, ignoring "stop" and "yield" signs, and crossing an intersection in red traffic light. Moreover, this manual method is usually employed only during daylight and is inherently ineffective due to human limitations. Many violators may escape while the officer is engaged in issuing one citation. Also, the presence of police may be detected by vehicle operators who momentarily obey the law.

Apart from enforcement by means of a close human intervention, there also exist certain semi-automatic systems, such as the one involving a camera that monitors vehicles crossing an intersection in red traffic lights. In this system a camera is activated by a magnetic sensor embedded inside the intersection. This sensor is sensitive to the presence of large metallic masses, but can not be relied upon for determining the exact position of the metallic mass. The still photographs thus acquired by the camera are stored internally for periods of days or weeks, until they are retrieved and examined manually.

Other devices include a rubber coated cable housing a piezoelectric detector along its length. This type of road sensor is commonly used in counting the number of vehicles traveling on the road. By its very construction, this sensor has a short life span, is prone to tampering by unauthorized individuals, and is inaccurate in determining time of event at a given point on the road since it tends to be dragged by the impacting wheel. Another existing road sensor is known as the magnetic loop. Here, changes in a current flowing in a conductor in the form of a loop that is caused by inductance are recorded and interpreted as indicating the approach of a metal body. This sensor is adequate for detection of a moving vehicle, but is inadequate for a precise measurement of location and time since the induced current is highly sensitive to the mass of the moving target. Moreover, it is very sensitive to electromagnetic radiation, such as that present near power lines.

Other passive sensors for detecting motion include an electronic setup involving a photoelectric cell. This detector would be triggered by a passing body that causes a discontinuity in the collimated light signal, much like the systems employed by automatic doors. However, such detector that is not housed inside a robust enclosure, as in the present invention, will be unreliable, prone to weather hazards such as rain, wind, and dust, and also prone to tempering by vandals.

Other existing road sensors are of the active type and include laser and radar detectors. These sensors, again, are placed on the surface and may not be enclosed inside a protecting enclosure. Moreover, these sensors are imprecise and limited in their functionality to determining the speed of a passing vehicle, and usually require a human operator for recording the events.

To summarize, the situation on the highways everywhere in the developed world is grave and becoming even more so with the natural increase in standards of living. The current statistics for the state of Israel includes a traffic accident every 25 min, a fatal accident every 18.5 hrs, a pedestrian involved in an accident every 2 hrs, and human injury every 14 min. Clearly, the solution may be found in either a massive increase in law enforcement personnel, or by exploiting novel technological methods and means.

SUMMARY OF THE INVENTION

The present system and method provide an answer to many serious problems in the modern traffic theater, and help maintaining security in various small communities and institutions. The public interest rests in the safe conduct on roads and highways. Commercial interests include the continuous operation of toll highways, parking garages, and other restricted access localities. In the commercial segment, the problem is the cost of keeping supervisory personnel. The proposed system, based on a novel passive road sensor, provides an adequate answer to this problem. The system is also uniquely situated for monitoring traffic in small and/or remote villages, thereby answering an acute need to controlling access and fighting crime.

The present invention is directed to an accurate passive road sensor for computing kinematics of moving vehicles and method for sensing, recording, and automatically reporting traffic events and traffic-law violations. The sensor includes a detector, an enclosure that participates in the detection mechanism in addition to protecting the detector, and a suitable opening in the road, possibly in the form of a suitable slit, in which the enclosure is placed. The road opening may further provide a small perturbation that could enhance the intensity of the effect generated by contact between the wheels of the passing vehicle and this sensor arrangement. Upon passage of a vehicle over this road sensor a perturbation is generated due to the impact with either the enclosure housing the detector, or the road opening in which the enclosure rests, or both. This perturbation in the form of a sound wave, a piezoelectric pulse, or a misaligned light beam is picked-up by the detector and transferred to a local processing unit, which is a suitable computer system, where the exact time of impact initiation is determined.

In the preferred embodiments, a passive sensor device is incorporated. A passive device does not require an active transmission of source signals fired at a target moving vehicle for reading at a subsequent time. Instead, a passive device reads certain forms of signals given directly by the vehicle (target) itself. Therefore, passive sensor systems are preferred since they can be remotely managed. On the other hand, an active system, such as a radar gun, typically requires a signal to be engaged with a target vehicle. Such a process often requires a high degree of accuracy and is difficult to maintain.

In a preferred embodiment of the invention, a system for passive monitoring a traffic flow comprises an acoustic generator and a detector. The acoustic generator includes a metal plate rigidly affixed across a lane of a road and a stainless pipe, portions of which are rigidly attached to a surface of the plate. Remaining lengthy portions of the pipe are free to vibrate. The detector is positioned anywhere within the pipe of the generator to detect sound pulses generated from impact of wheels of a vehicle to the generator as the vehicle is driven over the generator. Preferably, the end of the pipe is hermetically sealed after inserting the detector.

Preferably, the pipe has an inner diameter of about 4–10 mm and an outer diameter of 8–13 mm, and the lengthy remaining portion has a length of about 30–100 cm. The preferred plate has a width of about 5 cm and the pipe is spot welded to that plate.

The generator may be fixed to the road so that the pipe is embedded into a slot forged in a lane, the slot being sufficiently large to receive the pipe without touching the pipe. In one embodiment the pipe is positioned underneath the plate and the top surface of the plate may be roughened by small protrusions, or the plate may be bent to form a triangular protrusion of about 2–10 mm in height and 4–20 mm in width at its base. In another embodiment the pipe is situated on top of the plate, visible to an observer.

In use, two acoustic generators may be fixed across the lane and vehicle velocity may be computed from the two resultant signals. Further, a car's acceleration and the distance between axles of the vehicle may be computed from the signals data. A picture of the rear of the vehicle for enforcement purposes may be taken at a time after detection of the vehicle that is determined by the speed and distance between axles.

In the preferred embodiment the detector is a microphone. In this embodiment the opening in the road is in the form of a slit or groove, about 2 cm to 5 cm wide and about 0.5 cm to 3 cm deep, and it extends through almost the entire width of a given lane. If a road includes more than one lane in each traffic-flow direction, separate pairs of sensors would be preferred for each lane in order to unambiguously identify the passing vehicle. For this reason, and in order to eliminate any cross-talk between adjacent sensors, the road opening in each lane falls short of a full extension through the lanes width. The difference between lane's width and the length of the opening is of the order of 5 cm.

In the preferred embodiment the enclosure housing the sensing microphone is a common metal pipe, about 0.5 cm to 2 cm in diameter, and whose length is equal to, or shorter than, the opening in the road (i.e., the lane's width). The pipe may be sealed on both ends to protect against street noise and prevent penetration of water and dust particles. Preferably, the pipe is anchored inside the slit by suitable mechanical means, and/or by the use of epoxy resins. The pipe can fully fill the entire depth of the road opening, exceed this depth, in which case a small bump in the road will result, or fall short of a full coverage in which case a small depression in the road having sharp edges will result. In any of these cases, the pipe presents a unique resonance box that will provide a very sensitive listening device. When the front, or rear, wheels of a vehicle traverse over the sensor a unique sound is generated. In the preferred embodiment this sound wave is detected by a microphone, which continually monitors the sound inside the pipe enclosure, and is fed to the processing unit through a sampler. The processing unit determines which one of the possible multitude of sensors placed on the road, is involved in the particular event being recorded.

Impact can cause a sound wave to form by at least two different processes. The impact can generate a shock wave in the enclosure casing or in an air column inside the enclosure. In the preferred embodiment, vibrations in the casing of the enclosure, preferably made of a stainless steel metal pipe in this embodiment, may be sensed directly by the body of the microphone, which is in direct contact with the casing. Alternatively, the sound wave from the vibrating air column is detected by the microphone. In either case, a sound wave is generated and detected the sound ware having a well defined time pattern from which the exact impact initiation time can be deduced.

In another embodiment the detector is a photoelectric device arranged inside the enclosure for stability and protection against harsh road conditions. In this case, a collimated light beam is emitted at one end of the pipe and impinges on a photoelectric cell at the other end. This setup takes advantage of the fact that the solid enclosure will assure a straight communication line at all times when the system is at rest. In order to monitor impact, this embodiment is preferably implemented by having either the emitter or absorber rest on a hinge, a spring, or any other suitable arrangement. Then, upon the impact from the wheels of a moving vehicle, the shock wave causes the emitter, or absorber, to momentarily tilt or otherwise move off axis thereby interrupting the continuity of light detection, and thus triggering an electric pulse. This is recorded by the auxiliary circuitry and analyzed by the processing unit where the time of impact is determined. A similar embodiment would replace the photoelectric cell arrangement by an electromechanical switch device, such that when switched on momentarily owing to the impact with the wheels of a vehicle, a sharp signal is produced and recorded by the system.

In yet another embodiment of the present invention, the detector is made of a small element of a piezoelectric material which is tightly connected to the inside surface of the pipe. Here, again, the shock wave generated by the wheels impact with the pipe and/or road opening, causes an electric pulse to be generated by the piezoelectric element. As described above, this pulse is then detected by the auxiliary circuitry and its temporal characteristics analyzed by the system which thus determines the exact time of impact.

In each of the embodiments above, the vibration signal is conducted through the pipe.

As mentioned above, the enclosure housing the detector is preferably a metal pipe of appropriate diameter and length. It is further preferable to use stainless steel pipes, which are highly durable under all weather conditions, and are robust enough to withstand all types of impacts expected on the highway. In addition, this kind of enclosure is well known and readily available, and hence will result in substantial savings in fabrication expenses. Although, the preferred pipe is of a smaller diameter than the width of the slit cut in the road, it may be advantageous to use a pipe of same or larger diameter to protrude the pipe above the road surface. In some situations such an embodiment can provide stronger sound waves or electric pulses.

In another embodiment, the sensor may be positioned on the side of a road without involving a road-embedded enclosure. Instead, a sound detector may be placed adjacent a narrow groove on the road and detect sound waves caused by a passing vehicle as the wheels of the vehicle impact the groove.

The sensor of the present invention includes accurate and reliable detectors, a robust, long-lasting, housing enclosure, and a unique road feature. The latter is aimed at both anchoring the sensor in place on the road, and enhancing the impact that leads to a precise determination of the time of the impact. Since the sensor of the present invention involves an anchored solid enclosure, the point of impact is known precisely and remains constant with time. The ability to determine both time and location very accurately is of utmost importance in using this sensor for the determination of such parameters as the speed of vehicles, their acceleration, distance between following vehicles, and the like, as will be explained in the detailed description of the invention below.

BRIEF DESCRIPTION OF THE DRAWINGS

The particular features and advantages of the invention will be apparent from the following more detailed description of the preferred embodiments of the invention, as illustrated in the accompanying drawings. The drawings are not necessarily to scale, emphasis instead being placed upon illustrating the principles of the invention.

FIG. 8A is a side view and FIG. 8B is a plan view of another embodiment of the invention.

FIG. 9 is a perspective view of the embodiment of FIGS. 8A and 8B in position across a lane of traffic.

DETAILED DESCRIPTION OF THE INVENTION

Figure 1A:
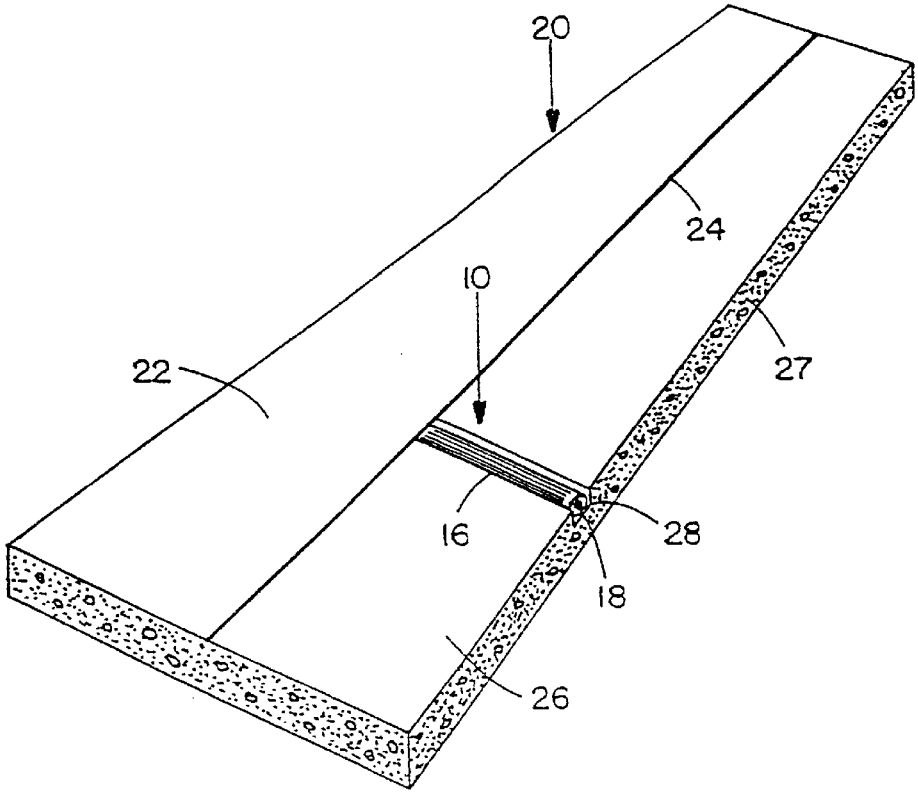
FIG. 1A is a schematic top oblique view of a segment of a road with the road sensor of the present invention embedded in one of its two lanes.
Figure 1B:
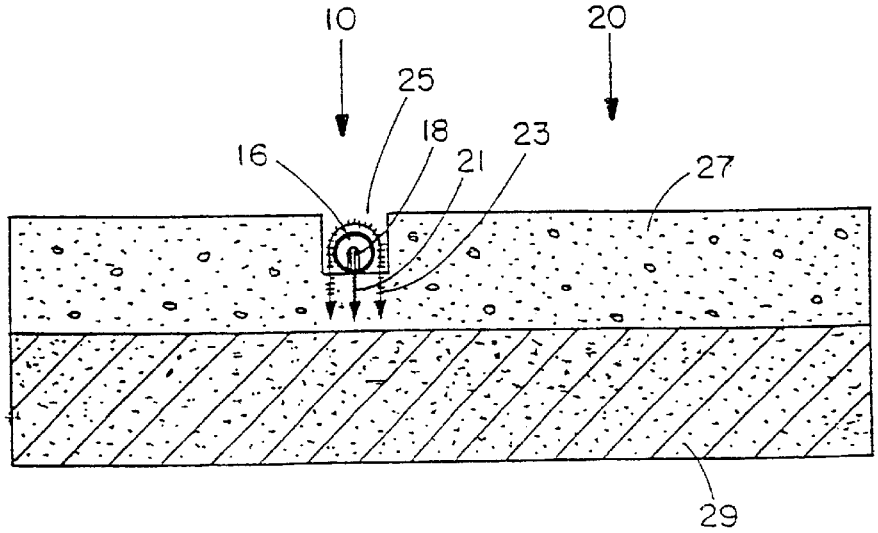
FIG. 1B is a schematic cross section of the road along its length depicting a schematic cross section of the road sensor of the invention.

FIG. 1A is a schematic top oblique view of one embodiment of the road sensor 10 of the invention. The road 20 includes at least two opposing lanes, 22 and 26, separated by the solid divide line 24. The sensor 10 includes the enclosure 16 and detector 18, in addition to the road opening 28 in which they are placed. FIG. 1B is a cross sectional view of a preferred embodiment of the sensor configuration 10 in the road 20.

The opening in the road 28 is in the form of a slit or groove formed in the smooth road pavement 27 that rests on the road foundation 29. The foundation can be of any type common in road construction, and the pavement, likewise, can be made of concrete, asphalt, or any other suitable material. When concrete is poured to form the pavement, it is a common practice to limit the length of each poured segment in order to allow for thermal expansion. In such a case, a natural slit is left between segments of concrete, which results in a unique sharp sound upon the impact of the wheels of a moving vehicle. If concrete were the material of choice in forming the pavement, the road opening 28 can be designed to overlap with this separation between adjacent segments of concrete. In the embodiment of FIGS. 1A and 1B, the opening is erected anywhere in the pavement material. In the preferred embodiment of the present invention, the width of the road opening 28 can be within the range of 0.5 cm to 10 cm and is preferably within the range of 1 cm to 5 cm.

The enclosure 16 is embedded in the road opening 28, such that it is either level with the top surface of the pavement, protrudes upwards from it, or leaves a depression in the road. As is shown in FIG. 1B, in the preferred embodiment of the present invention a small depression 25 is left behind in the road after anchoring the enclosure in place, in order to maximize the impact of the sensor 10 with the wheels of a moving vehicle, thereby maximizing the strength of the signal that is picked up by detector 18 positioned inside enclosure 16. In order to anchor enclosure 16 inside the road opening, any one of several suitable materials, such as concrete, asphalt, resin, etc. can be used to fill road opening 28 around the enclosure. In the preferred embodiment of the present invention, additional anchoring is provided by element 23, which is a "U" shaped anchor forced over the enclosure 16 and into the pavement 27 in several positions along its length. Alternatively, the enclosure 16 can be fitted with nail elements 21 so that by applying mechanical force on the top side of the enclosure 16 the nails are inserted into the pavement to form a tight anchor.

In one preferred embodiment of the present invention, enclosure 16 is a suitable metal pipe, preferably a stainless steel pipe as is commonly used in industrial applications. Preferably, the outer diameter of this pipe is smaller than the width of opening 28. Specifically, the outer diameter of the enclosure pipe 16 of the present invention can be within a range of 0.3 cm to 9 cm and is preferably within the range of 0.8 cm and 4 cm. The inner diameter of enclosure pipe 16 should be such that detector 18 can be inserted and placed comfortably, while maintaining adequate strength against pressure exerted by heavy vehicles moving on the road. In the preferred embodiment of the present invention the inner diameter can be within the range of 0.2 cm to 8 cm and is preferably within the range of 0.5 cm to 3 cm.

The detector 18 of the present invention can be of any type that is sensitive to mechanical impact, as that experienced by enclosure 16 in opening 28 upon coming in contact with the wheels of a moving vehicle. Specifically, detector 18 can be chosen among the group of various passive sensor devices such as microphones, photocells, piezoelectric elements, and combinations of electromagnetic transmitters and receivers. In the preferred embodiment, a passive sensor device is incorporated. A passive device does not require an active transmission of source signals fired at a target moving vehicle for reading at a subsequent time. Instead, a passive device reads certain forms of signals given directly by the vehicle (target) itself. Therefore, passive sensor systems are preferred since they can be remotely managed. On the other hand, an active system, such as a radar gun, typically requires a signal to be engaged with a target vehicle. Such a process often requires a high degree of accuracy and is difficult to maintain.

Although detector 18 may be positioned on the side of the road adjacent to the road opening 28, it is preferably positioned inside enclosure 16 which generates vibrations upon impact. Such positioning is also important for long-time protection against harsh road conditions, to ensure accurate alignment necessary for certain types of detectors such as those based on photocells, and to assure a high signal-to-noise ratio for an accurate and reliable operation. Enclosure 16 is equipped with two stoppers, or similar fittings, applied at its two ends in order to assure a tightly close system.

Detectors based on a photocell as the sensing element employ a collimated light source at one end of enclosure 16 and a photocell at the opposite end. Either one, or both, can be fitted on a hinge such that a suitable mechanical impact will force either or both elements of detector 18 to tilt of off the main longitudinal axis of enclosure 16, thereby causing a signal to be triggered in an auxiliary electronic circuit that monitors the current through the photocell. The time of this signal is recorded by the processor unit that controls the operation of the sensor system as the time of contact between the moving vehicle and the site of the sensor.

A detector 18 that is based on a piezoelectric device depends on the well known physical phenomena of converting mechanical energy into electrical energy. Thus, the firing of an electric signal is realized as a result of the impact with the sensor and the time of this event is, again, recorded by the processor unit.

In one preferred embodiment of the present invention the detector 18 is a suitable microphone chosen among a multitude of available microphones that differ in physical size, sensitivity, directionality, construction, and principle of operation. The microphone detector 18 is in a continually listening mode, and is in continuous communication with the processor unit. When impact with opening 28 occurs, a sound wave is generated in the enclosure and detected by the microphone. This sound wave is recorded by the processor unit and analyzed to determine the exact onset of impact, thereby determining the exact time at which the vehicle's wheels crossed the known position of sensor 10. As shall be explained in detail in what follows, this exact time record will then be used to determine compliance of the moving vehicle with various traffic laws and regulations.

Figure 2:
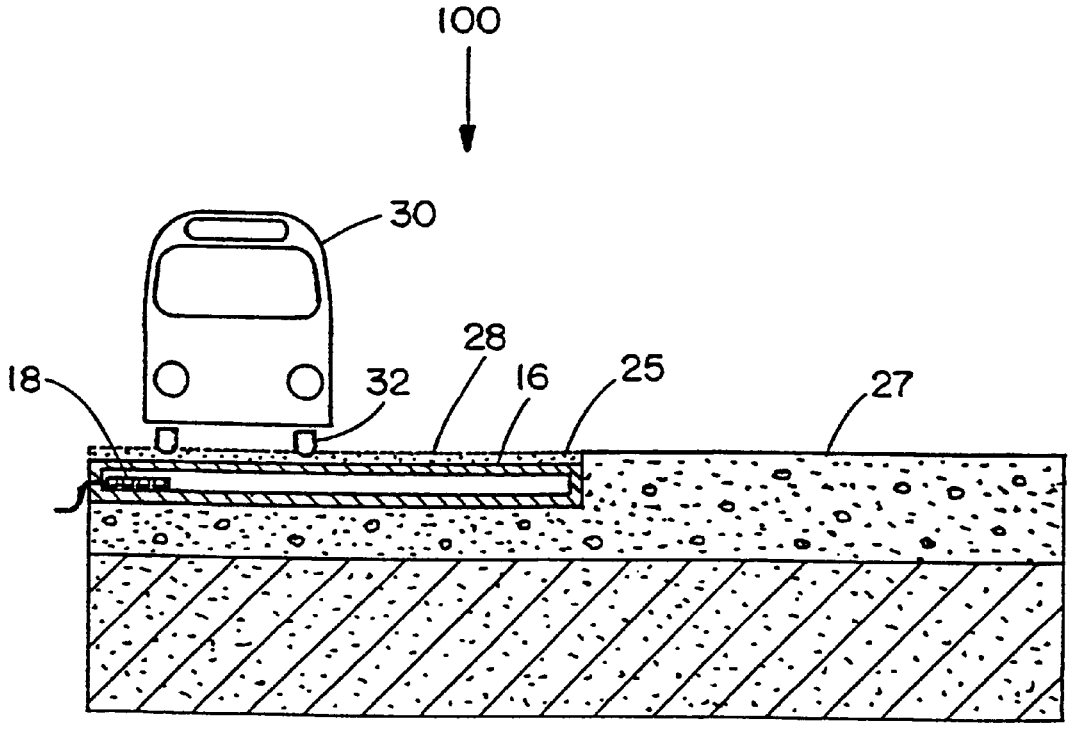
FIG. 2 is a schematic cross section of the road along its width at the position of one embodiment of the road sensor of the invention.

FIG. 2 is a schematic cross sectional diagram of the preferred embodiment 100 of the present invention, along the width of road 20 at the center of sensor 10. Road depression 25 is left in road opening 28 after placement of enclosure 16. Wheels 32 of moving vehicle 30 are seen entering depression 25 just prior to impacting with enclosure 16. Road depression 25 is typically of the same width and length as that of road opening 28. The depth of road depression 25 can be within the range of 0.2 cm to 5 cm and is preferably within the range of 0.5 cm to 2 cm. Such a value for the depth of the road depression 25 is adequate for securing a meaningful impact without causing an undue annoying disturbance to the moving vehicle. Microphone detector 18 of the preferred embodiment is seen inside enclosure 16. Microphone detector 18 may be positioned anywhere inside enclosure 16, but is preferably situated at the center of enclosure 16.

Figure 3A:
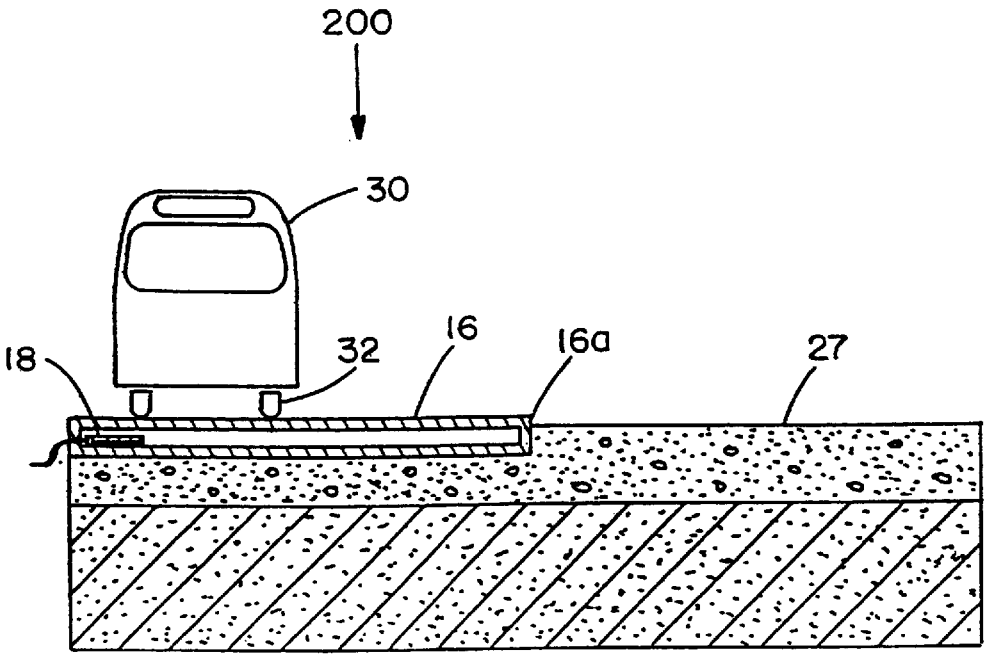
FIGS. 3A and 3B are schematic cross sections of alternative preferred embodiments of the road sensor.
Figure 3B:
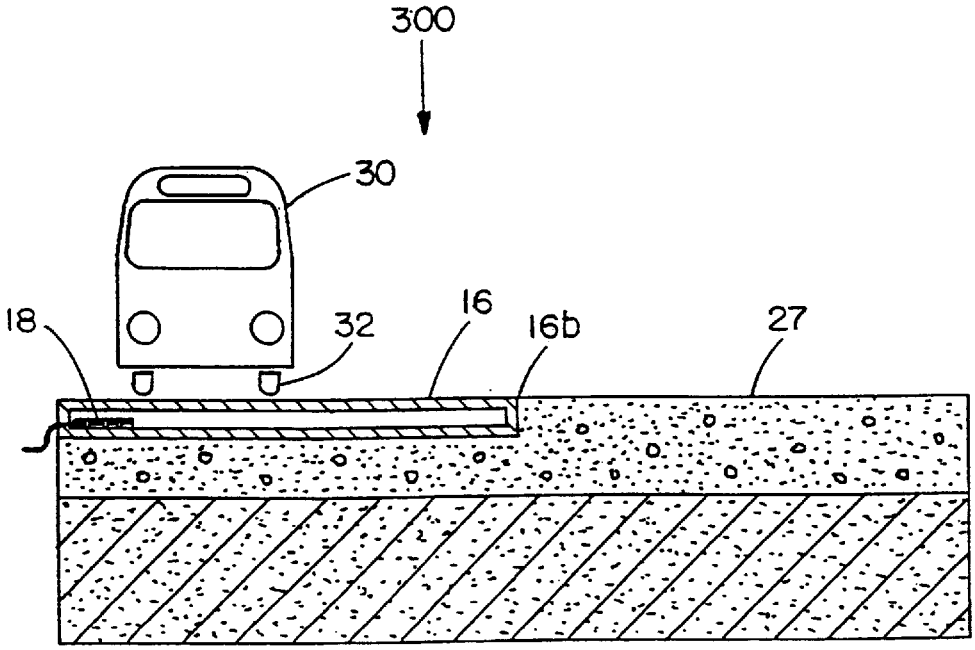

FIGS. 3A and 3B are schematic cross sectional diagrams of alternative embodiments 200 and 300, respectively, of the passive road sensor of the present invention. In the embodiment 200 illustrated in FIG. 3A, in similar fashion to the previously described embodiment, the depth of road opening 28 is of a lesser value than the diameter of enclosure 16 resulting in a protrusion 16*a* of enclosure 16, having a certain height above the flat surface of pavement 27. The height of protrusion 16*a* above pavement 27 can be roughly within the range of 0.2 cm to 5 cm and is preferably within the range of 0.5 cm and 2 cm. Wheels 32 of vehicle 30 must impact with protrusion 16*a* upon crossing sensor 10, thereby actuating detector 18. In the preferred embodiment of the present invention detector 18 is a microphone, and the impact of wheels 32 with protrusion 16*a* results in a sound wave whose time characteristics are recorded and analyzed by the auxiliary processor of the integrated system of the present invention.

In the alternative embodiment 300 illustrated in FIG. 3B, the depth of road opening 28 is equal to the diameter of enclosure 16 so that a flat surface 16*b* results in the location of sensor 10 after filling the voids with the anchor material, as described above. Surface 16*b* is level with the top surface of pavement 27. In the preferred embodiment of the present invention detector microphone 18 records the amplitude of the sound vibrations created in pavement 27 by a moving vehicle 30. The amplitude reaches a maximum when wheels 32 are exactly over detector 18, thus enabling a precise identification of the time when wheels 32 traversed sensor 10.

Figure 4A:
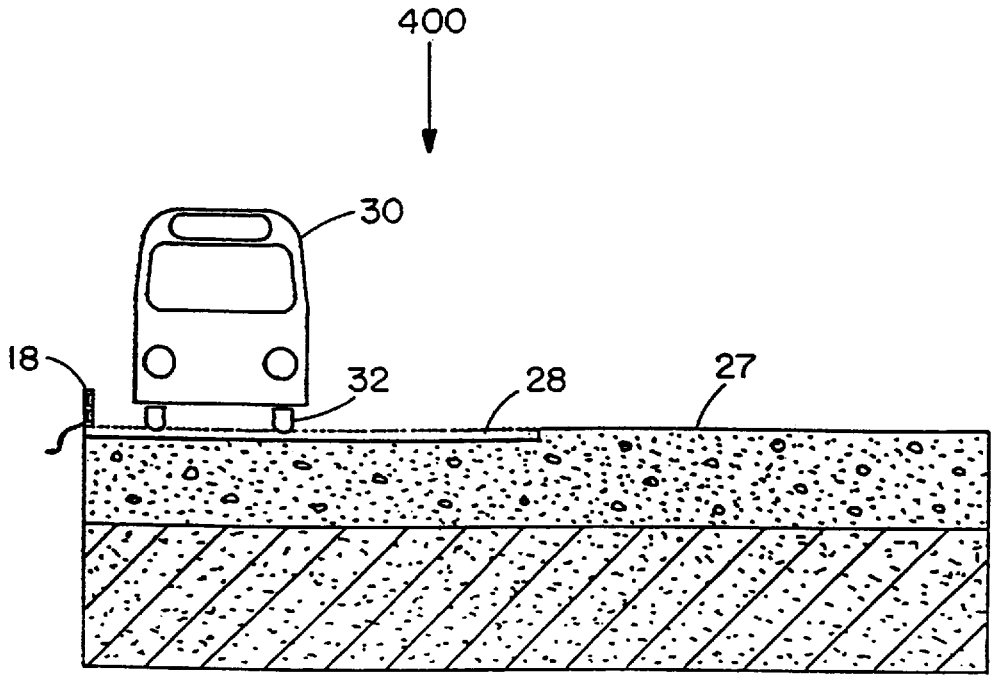
FIGS. 4A and 4B are schematic cross sections of alternative embodiments of the road sensor.
Figure 4B:
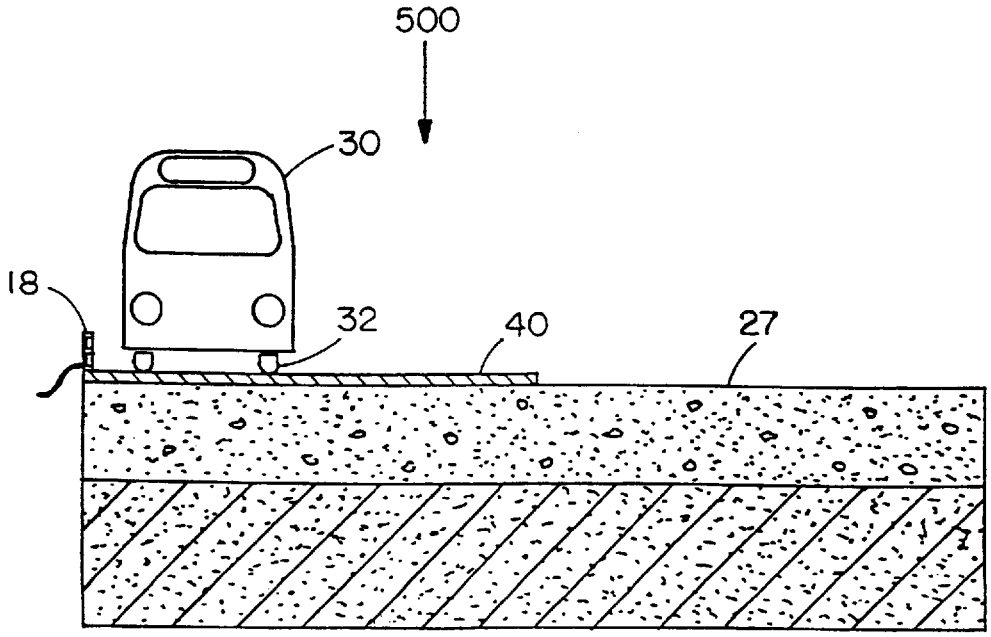

FIGS. 4A and 4B are schematic cross sections of alternative embodiments 400 and 500 of the passive road sensor 10 of FIGS. 1A and 1B. Common to both configurations is the absence of enclosure 16 of the preferred embodiment of FIGS. 1A and 1B. In these alternative embodiments detector 18 is placed at the side of the road 20 close to the surface of pavement 27. In the embodiment 400 of FIG. 4A road opening 28 is a relatively shallow slit, or groove, whose depth can be within the range of 0 cm to 5 cm and is preferably within the range of 0 cm and 2 cm. A physical groove in road 20 is needed for a sound detector 18 such as a microphone, which depends for its operation on the creation of a distinct sound signal, such as that produced upon the impact of wheels 32 with groove 28.

In the alternative embodiment 500 of FIG. 4B, in similar fashion to the previously described embodiment, detector 18 is placed on the side of road 20 adjacent to the surface of pavement 27. At the position of detector 18 a shallow and narrow road obstacle 40 is placed across the road's or lane's width. Obstacle 40 may be in the form of a small road bump whose height can be within the range of 1 cm to 10 cm and is preferably within the range of 1 cm and 3 cm. The width of obstacle 40 can be within the range of 1 cm to 20 cm and is preferably within the range of 1 cm and 5 cm. Alternatively, road obstacle 40 is a solid line of an arbitrary cross section made of metal, rubber, or any other suitable material. Preferably, obstacle 40 is of a round cross section and is in the form of a cable or rope whose diameter can be within the range of 0.5 cm to 5 cm and is preferably within the range of 0.5 cm and 2 cm. In such a case the cable or rope 40 can be anchored in place by elements such as anchor 23 in FIG. 1B.

Figure 5:
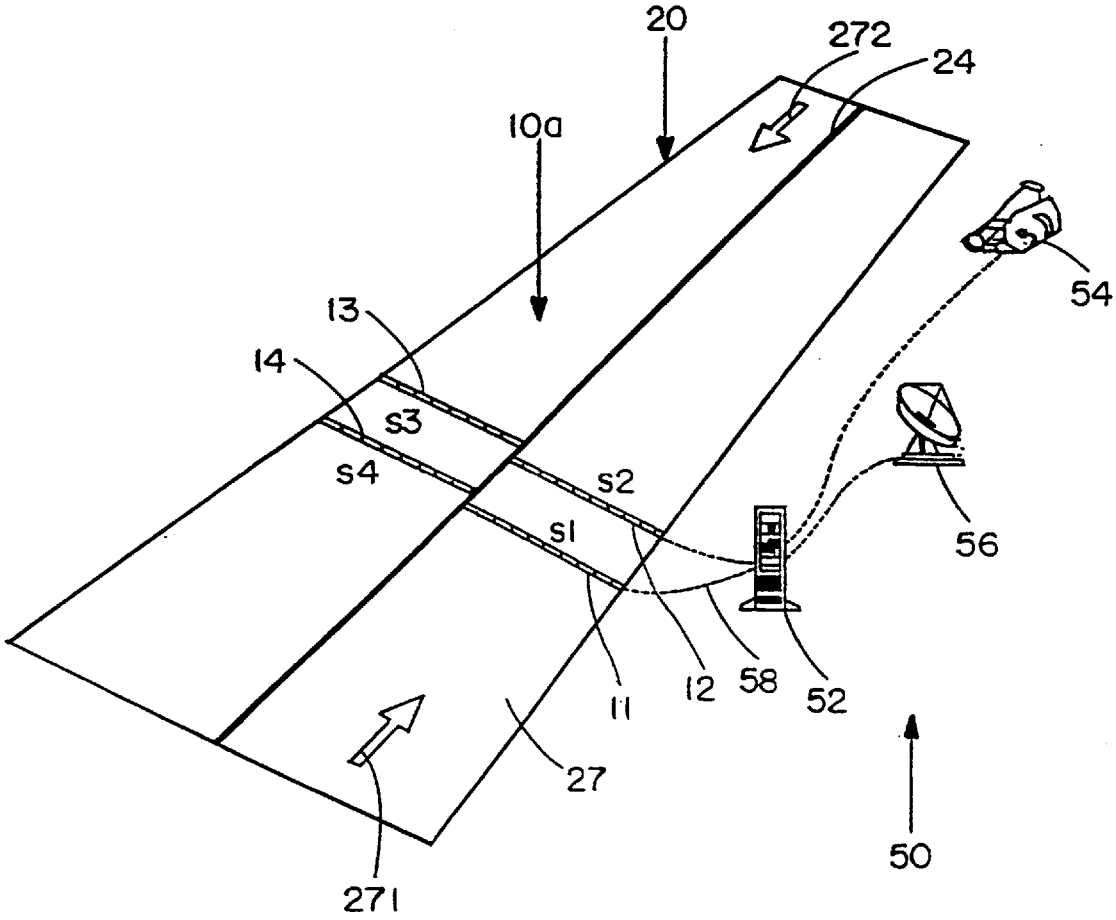
FIG. 5 is a schematic top oblique view of a preferred embodiment of an integrated traffic law enforcement system aimed at monitoring vehicle's velocity and unlawful overtaking at a solid divide line.

FIG. 5 is a top oblique view of road segment 20 together with automatic traffic monitoring system 50 that is integrated with sensor system 10*a*. Road segment 20 includes at least one lane in each traffic direction illustrated by arrows 271 and 272. Solid divide line 24 separates traffic directions 271 and 272. Monitoring system 50 includes processor unit 52, video camera 54, communication unit 56, and interwiring system 58. The sensing system layout 10*a* includes sensors s1 and s2 in traffic direction 271 identified by reference numeral 11 and 12, respectively, and sensors s3 and s4 in traffic direction 272 identified by reference numerals 13 and 14, respectively.

The integrated traffic monitoring system of FIG. 5 can be used to monitor such parameters as vehicle's speed, distance between following vehicles, and unlawful crossing of the solid divide line 24.

The distance between sensors 11 and 12, and sensors 13 and 14, is accurately known. In the preferred embodiment of the present invention this distance is of the order of a typical car's length, so as to eliminate any possibility that sensors 11 and 12 belonging to one particular lane will be activated by two different vehicles. Specifically, the distance between sensors 11 and 12 of the present invention can be within the range of 10 cm to 500 cm and is preferably within the range of 50 cm and 200 cm. Similarly, the distance between sensors 13 and 14 of the present invention can be within the range of 10 cm to 500 cm and is preferably within the range of 50 cm and 200 cm.

When a vehicle travels on road 20 along traffic direction 271 its front wheels first contact sensor 11 and then sensor 12. Upon the impact with sensor 11 a signal is recorded by processor unit 52 and analyzed to determine the impact time, t1. When the front wheels of the vehicle impact, next, with sensor 12 impact time, t2, is similarly determined. Processor unit then determines the vehicles velocity by dividing the known distance between sensors 11 and 12 by the time difference, t2−t1. Similarly, the system determines the precise times at which the rear wheels pass over sensors 11 and 12 and uses these data to calculate the acceleration, if any.

Figure 6A:
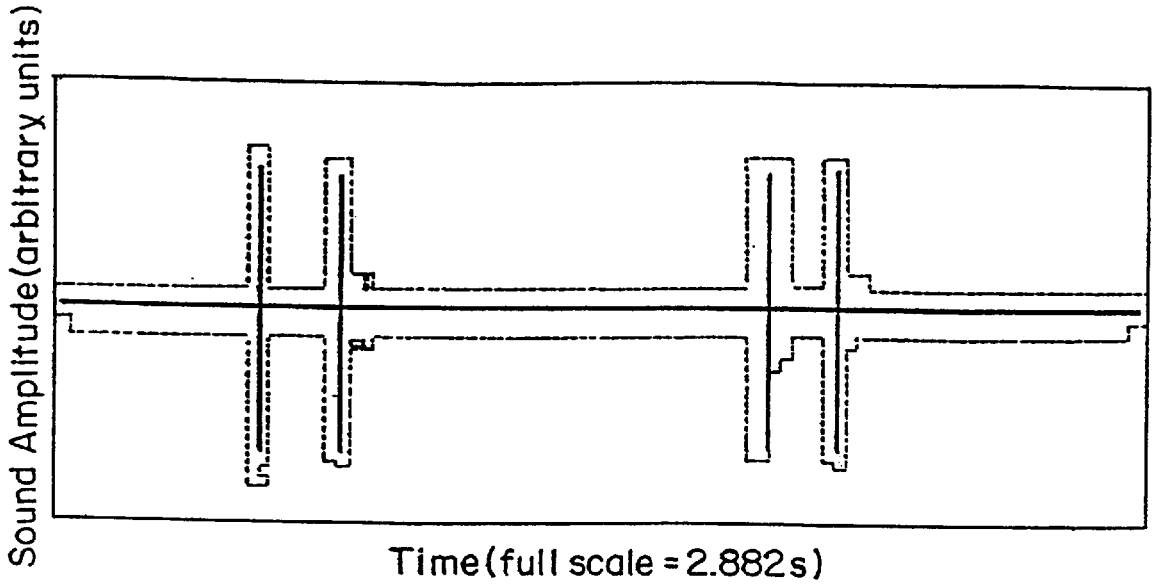
FIGS. 6A and 6B are illustrations of typical results recorded by a sound detector.
Figure 6B:
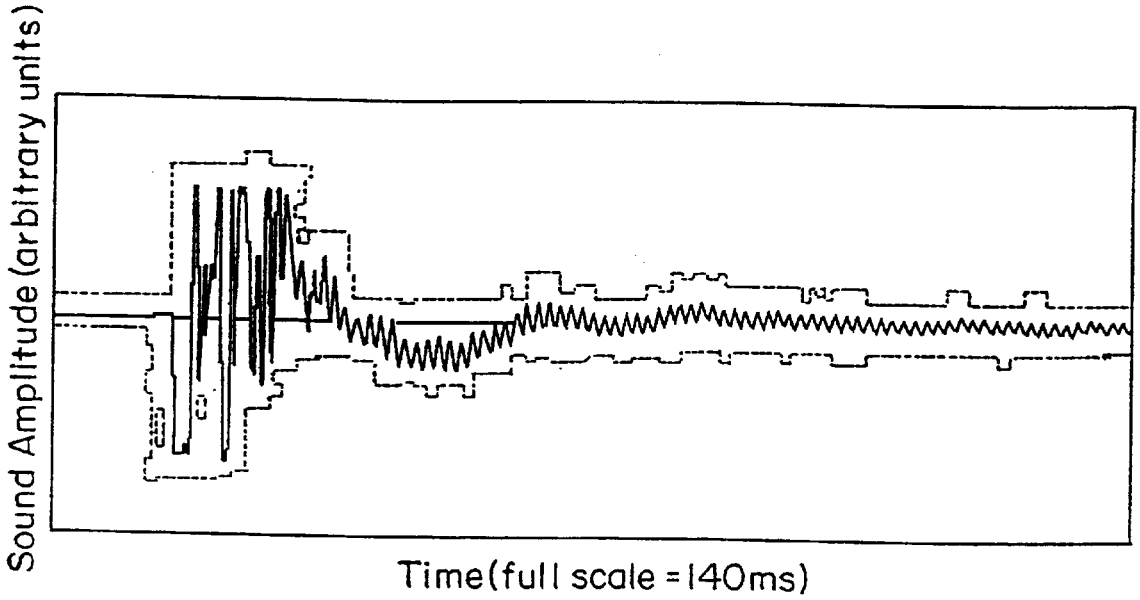

FIGS. 6A and 6B are illustration depicting actual data recorded by microphone detector 18 of the preferred embodiment in FIG. 1A. FIG. 6A shows two pairs of signals resulting from two independent events where the amplitude of the sound wave is plotted as a function of the elapsed time. The total time scale is 2.882 seconds. FIG. 6B depicts a typical result of magnifying one of the four recorded events in FIG. 6A. Here the third sound wave from left in FIG. 6A is shown. The onset of the sound wave, resulting from an impact, is seen to be very sharp allowing a highly precise determination of this time parameter. The time resolution is better than 1/10,000th of one second. Typically, the time interval described above, t2−t1, for a vehicle moving at a normal highway speed is of the order of 1/10th of one second.

The processor unit uses data on vehicles velocity and the time interval that elapses between two consecutive events to also determine the distance between following vehicles. The results regarding the velocity and distance between vehicles are then compared to allowable values. If any one parameter is in variance with the allowed value, the processor grabs the relevant frame from the video camera 54 of FIG. 5, which is turned continuously on. The image of the front or rear of the vehicle is then analyzed using a suitable algorithm aimed at extracting the license plate registration number. A file containing the data on time, location, nature of traffic law violation and relevant parameters, registration number, and the image of the vehicle is then prepared and transmitted via communication device 56 in FIG. 5 to a central processing and control unit where vehicle ownership is determined and citations issued.

Sensor layout 10*a* in FIG. 5 in conjunction with monitoring system 50 can be used, in addition, to monitor illegal crossing of a solid divide line. As described above, a vehicle moving along direction 271 first encounters sensor 11 and then sensor 12. Processor unit records this order of events. If, however, it first records an encounter with sensor 12 along direction 271 and only thereafter with sensor 11 it interprets the reversed sequence of events as a case of motion in the wrong direction and the process of event recording and reporting is repeated as described in the previous case. Clearly, in order to monitor a longer segment of road 20 against illegal crossing of the solid divide line, a multitude of sensors can be embedded along the chosen segment so as to assure that any such attempt will be duly recorded. Moreover, these additional sensors can be designed to be shorter than the width of the lane, so as to allow for an occasional, unintended, drift of a vehicle to the opposite direction.

For example, consider a vehicle moving at a speed of 90 Km/hr (about 55 miles/hr) and being overtaken by a second vehicle moving at the speed of 110 Km/hr (about 70 miles/hr). Assume that the second vehicle first approaches the first one to within 20 m before starting to overtake it, and immediately returns to the right lane upon completing the process, such that the distance between the two vehicles is, again, 20 m. With these parameters the time required to complete the overtaking process is of the order of 8 seconds. Allowing for extra acceleration time, the overall time is about 10 seconds. This then leads to a typical "overtaking length" equal to 300 m (roughly a fifth of a mile). Such a road span can be comfortably monitored by dividing it into four equal segments using three pairs of passive road sensors of the invention in each lane. This arrangement will assure that nearly no vehicle will be able to avoid being detected if moving against the allowed traffic direction.

Figure 7:
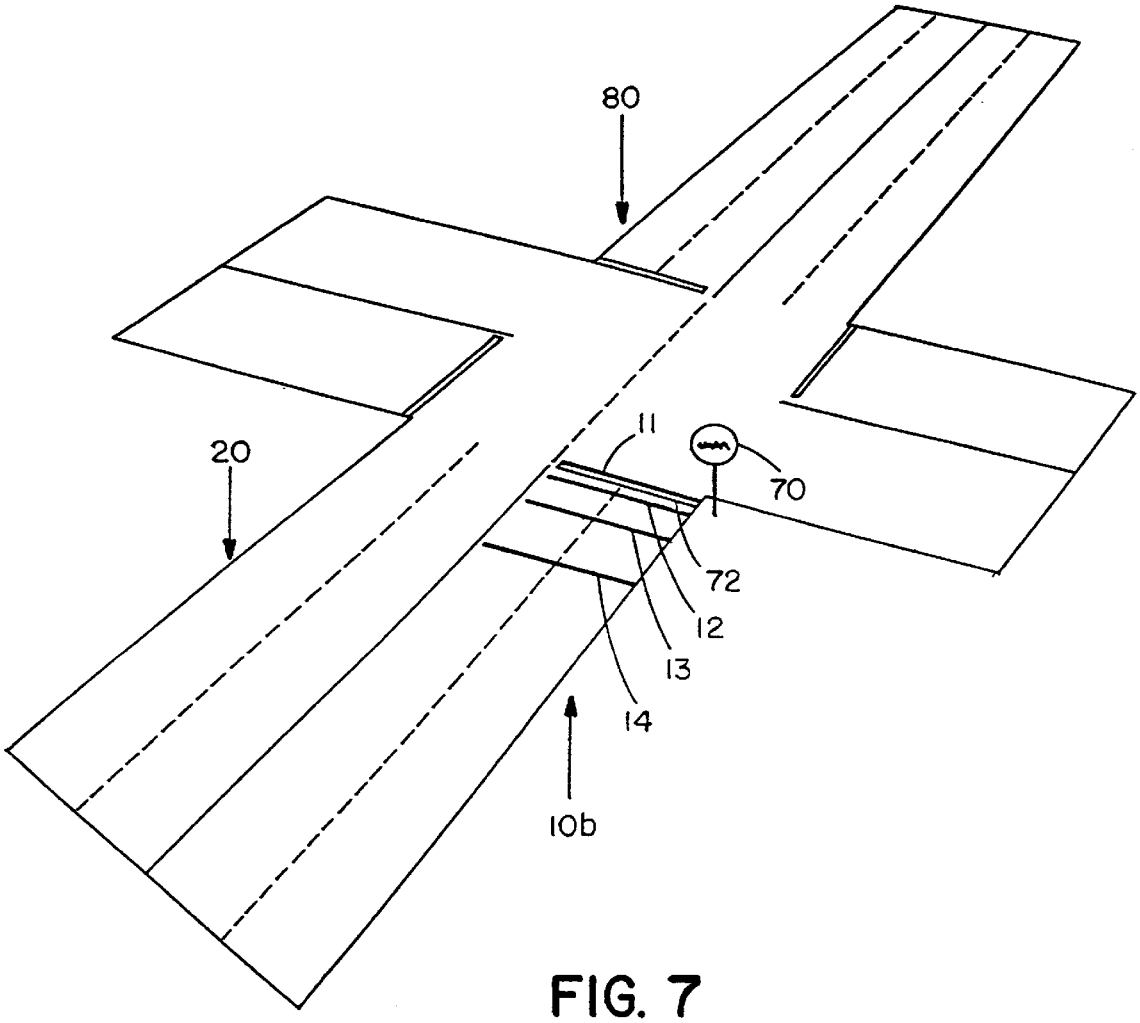
FIG. 7 is a schematic top oblique view of another embodiment of an integrated traffic law enforcement system aimed at monitoring obedience to a stop sign. In this illustration, only one of the four possible stop signs is highlighted.

FIG. 7 is a top oblique view of road intersection 80 with stop signs in all directions (only one is shown in diagram). Road 20 is equipped with sensor system 10*b*, stop sign 70 and stop mark line 72.

When a vehicle approaches the stop sign traveling on the right lane it first encounters sensor 14 and then, sequentially, sensors 13, 12 and finally 11. The distance between each two consecutive sensors becomes shorter towards the stop sign. The vehicle is required to come to a complete stop at the mark line 72 before proceeding. Sensors 14, 13, and 12 are used to determine the deceleration rate of the vehicle. This is then used to calculate the time needed for the vehicle to traverse the distance between sensors 12 and 11 if it were to ignore the stop sign. The system then expects that the vehicle will stay between sensors 12 and 11, i.e., at mark line 72 for a period of time that exceeds the value of this calculation by some prescribed value. If this condition is not met, the event recording process described above for velocity violation is initiated.

In another preferred embodiment, as shown in FIGS. 8A and 8B, a pipe 801 is fixedly attached to a thin metal plate 803 to form an acoustic sensor 800. The pipe can be attached by any of the suitable conventional means, such as welding, clamping, or cementing. In the preferred embodiment the pipe is made of stainless steel and is spot-welded 805, leaving a substantial portion of the pipe 807 free from the plate so that the pipe is allowed to vibrate upon a substantial impact. Preferably, the non-connected segment 807 is between 30–100 cm in length depending on the overall lane width. For a longer unit, additional welds may be provided. Two pairs of welds are provided at each end of each free span for durability. Preferably, the pipe has an inner diameter of about 4–10 mm and an outer diameter of about 8–13 mm. The metal plate has a preferred width of about 5 cm and is long enough to substantially cover a typical width of a lane in a highway. FIG. 8G illustrates a similar embodiment in which only one pair of welds 840 is necessary.

Figure 8C:
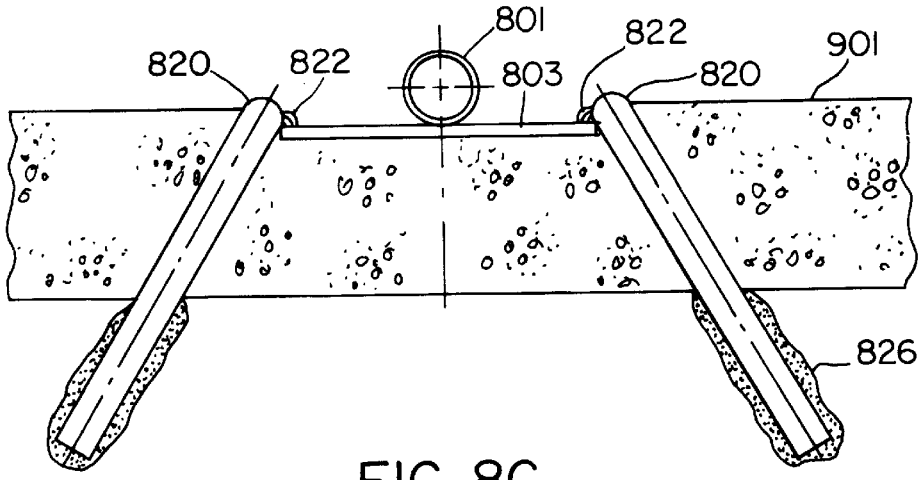
FIGS. 8C and 8D are side and top view respectively which illustrate the anchoring of the detector to the road.
Figure 8D:
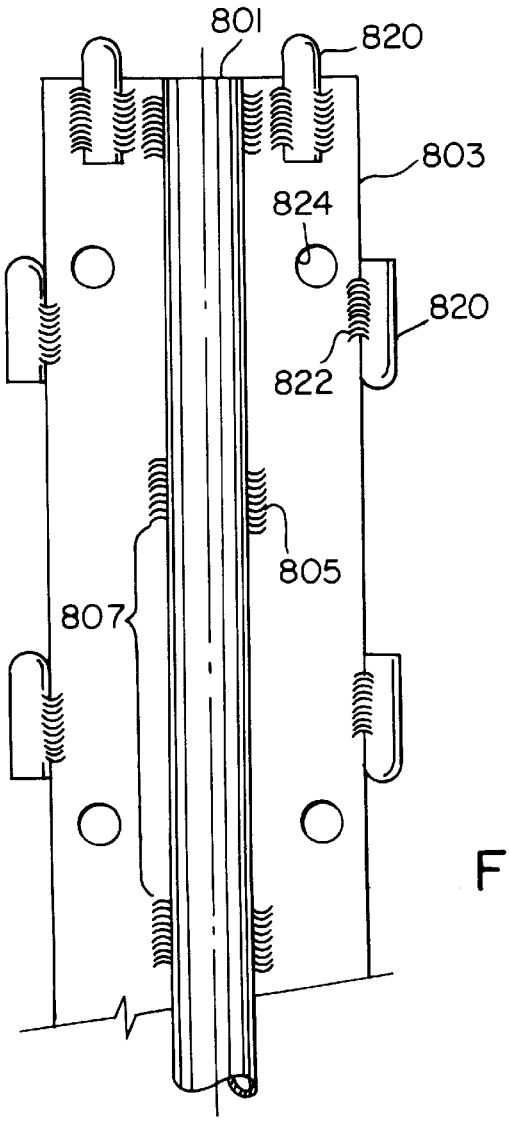

FIGS. 8C and 8D show a preferred manner of fixing this embodiment to the road surface 901. First, epoxy is applied to the bottom of the plate 803 to hold the plate 803 to the surface. Holes 824 in the plate 803 allow the epoxy to overflow locally thus securing a better grip of the plate 803 to the pavement. These holes are situated about 10 to 100 cm from each other, preferably about 50 cm, and have a preferred diameter of approximately 6 mm.

Figure 8E:
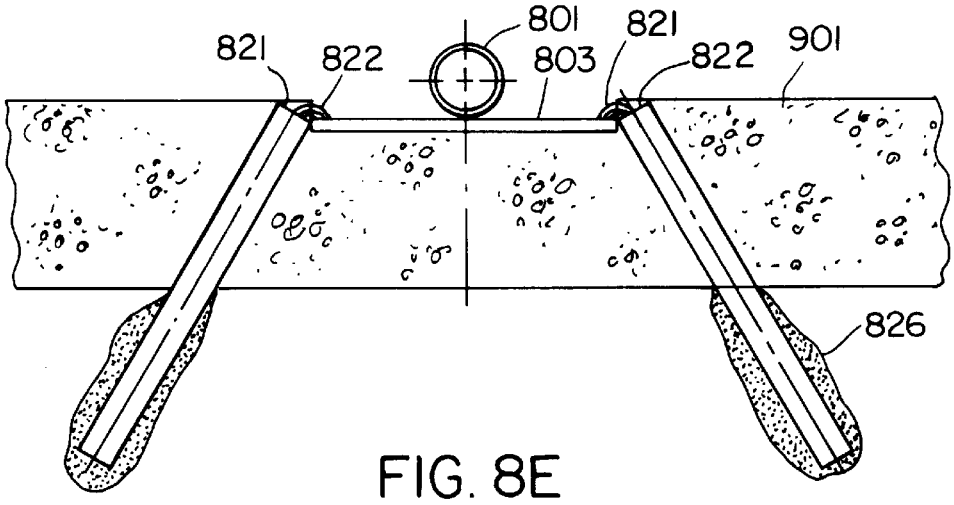
FIGS. 8E and 8F illustrate an alternate anchoring embodiment.
Figure 8F:
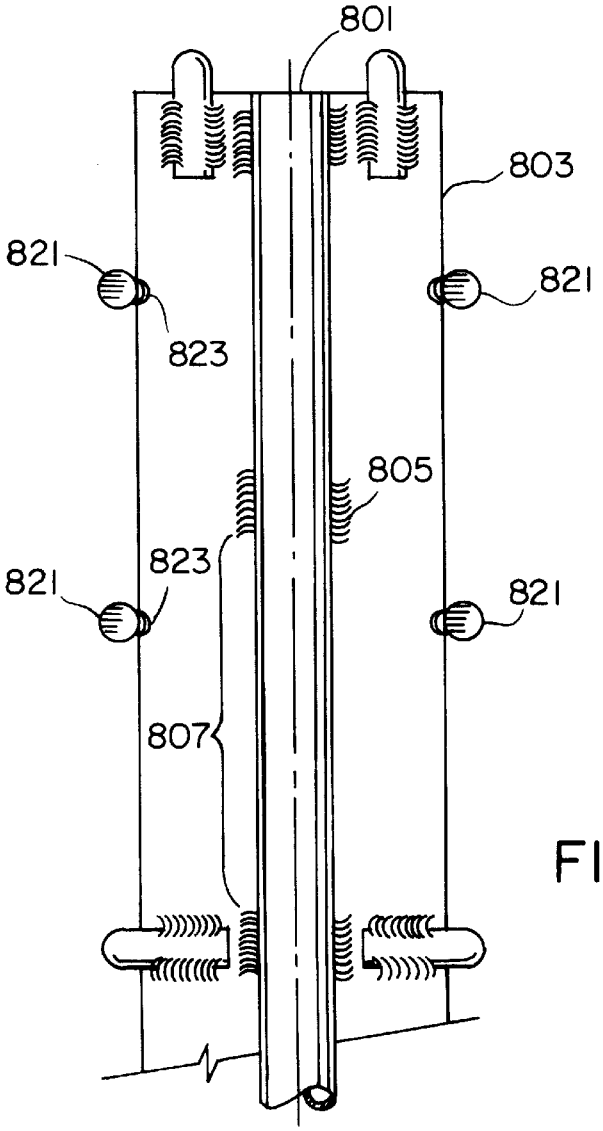
Figure 8G:
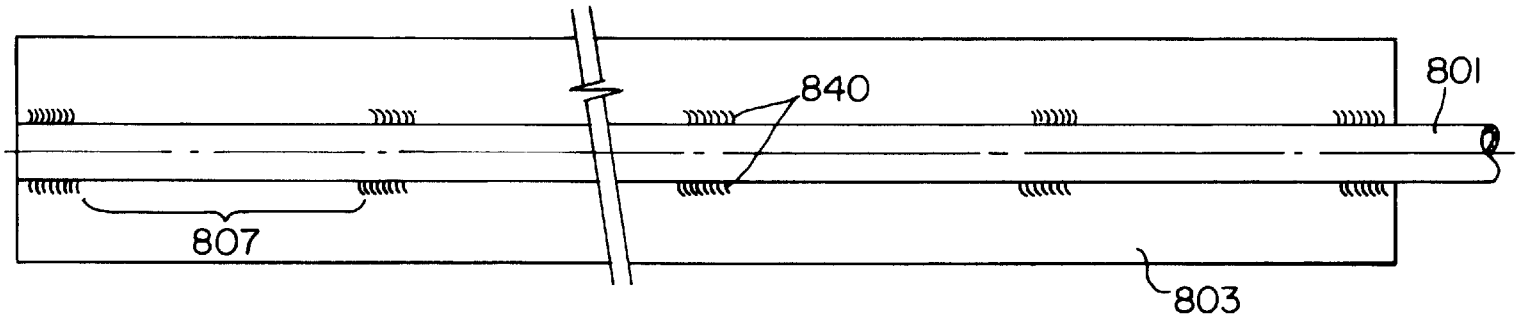
FIG. 8G illustrates the top view of an embodiment similar to that shown in FIGS. 8A and 8B.

The plate 803 is further anchored with steel rods 820 as are typically used to reinforce concrete. These steel rods 820 are about 20 cm long and angled at approximately 45 degrees into the road surface 901. The steel rods 820 should be located along the length of the plate approximately 50 cm apart as well as at the ends of the plate 803. Each steel rod 820 is installed by first drilling a hole into the road surface 901 with the appropriate spacing, angle and depth. The hole is filled with epoxy to help anchor the steel rod beneath the road surface and the steel rod is driven into the hole. Finally, each steel rod 820 is welded 822 to the plate 803. The tops of the steel rods 820 as shown in FIGS. 8C and 8D are bent, the bent portion being welded 822 to the plate 803. FIGS. 8E and 8F illustrate an alternative embodiment in which steel rods 821 are driven straight into the road 901 and the unbent tops welded 823 to the plate 803.

Because arbitrary placement of a microphone within the sensor pipe could result in the microphone being located at a weld 805 where vibrations are dampened, the preferred embodiment uses a plurality of microphones, preferably spaced about 1 m apart, or such that if one microphone is arbitrarily placed at a weld 805, the remaining microphones will not be located at welds.

Figure 10A:
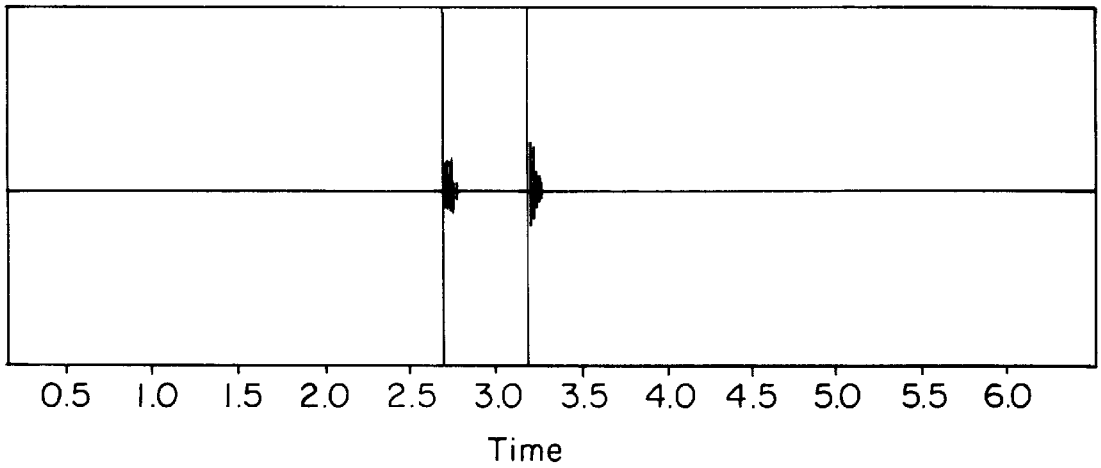
FIGS. 10A and 10B illustrate detector outputs from the embodiment of FIGS. 8A and 8B.
Figure 10B:
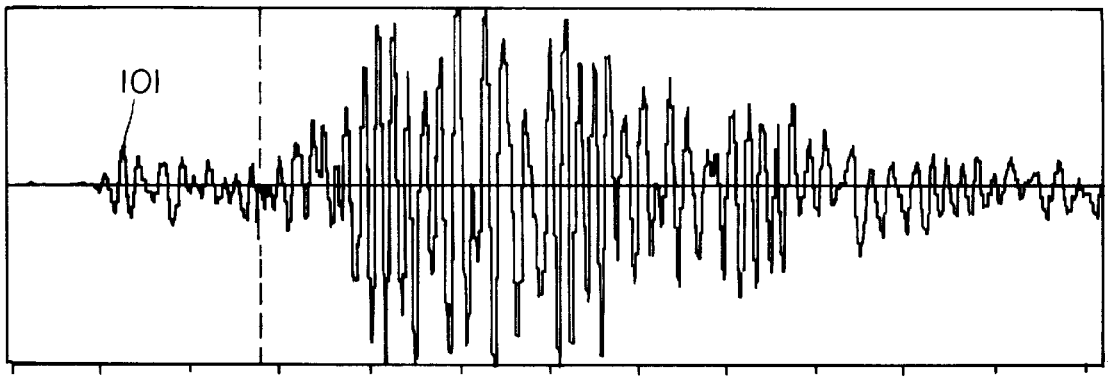

In the preferred embodiment, the metal plate of the sensor 800 can be fixed to a road surface 901, as shown in FIG. 9, to have the pipe 801 protrude from the surface of the road. A detector unit 903 having a conventional microphone 905 is installed adjacent one end of the sensor 800 to detect any acoustic waves generated by impact with vehicles driven over the sensor in a normal traffic situation. Pipe 801 of sensor 800 is then hermetically sealed with the microphone 905 therein to prevent street noise from being picked-up by microphone 905. FIGS. 10A and 10B illustrate a graphical result of the preferred sensor 800. FIG. 10A shows two sound pulses resulting from impacts from front and rear sets of wheels of a vehicle traveling over the sensor 800. FIG. 10B is an enlarged view of the leading pulse in FIG. 10A. As previously described, the vehicle velocity can be computed from two sensors spaced at a known distance.

In FIG. 10A, it is demonstrated that virtually no noise is picked up by the sensor 800 beyond the impact points. One of the key factors for such a high yield of signal-to-noise ratio is the fact that the pipe 801, through its unwelded portion 807, is allowed to resonate only during a high impact such as a wheel-impact from an automobile. The welded spots 805 maintain the pipe sufficiently rigid with respect to the road to prevent the pipe 801 from resonating from other road noises in the area that are not directly impacting the pipe. As a result, the determination of a vehicle velocity can be achieved within a few hundredths of percent error. For example, in FIG. 10B, selecting any point in the whited-out region as the starting reference point ensures accuracy within 0.03%.

Figure 12:
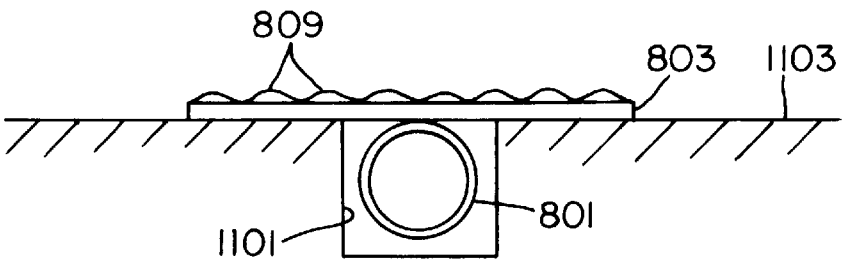
FIGS. 11, 12, 13A and 14 are end views of three alternative embodiments similar to that of FIGS. 8A and 8B but inverted to position the pipe within a trench.
Figure 11:
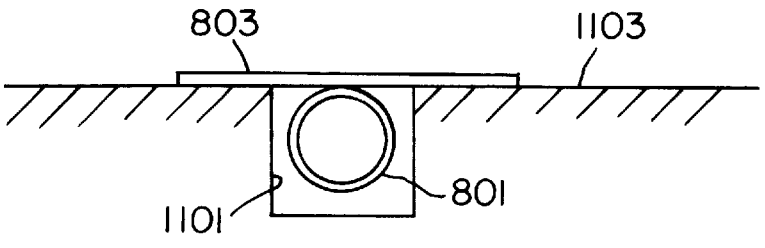
Figure 13A:
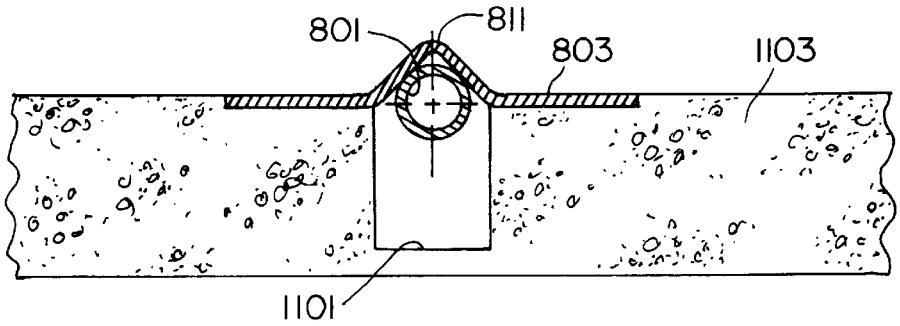
Figure 13B:
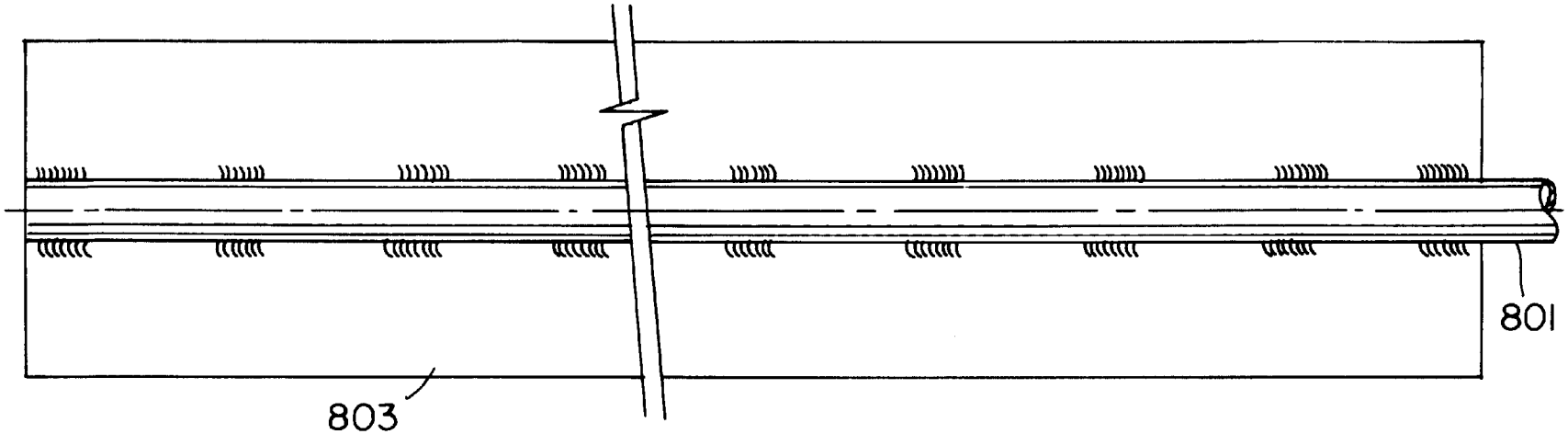
FIGS. 13B and 13C illustrate a bottom and side view, respectively, of the embodiment shown in FIG. 13A.
Figure 13C:
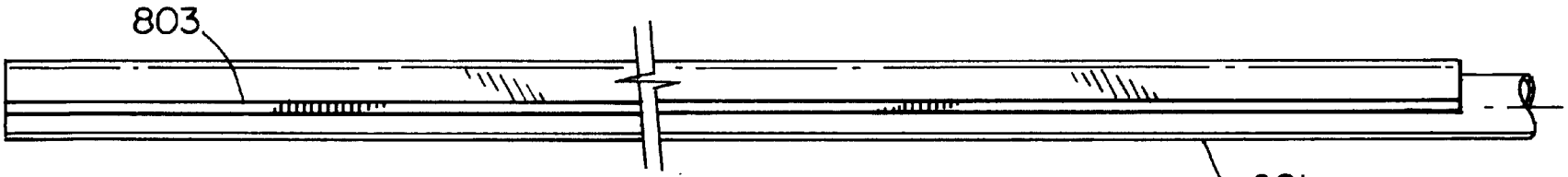

FIG. 11 illustrates another embodiment of implementing the preferred sensor device shown in FIG. 8. FIG. 11 depicts a side cut-away view of a road 1103 in which the pipe 801 is laid in a slot 1101 in the road. The slot 1101 is configured to be slightly larger than the outer diameter of the pipe 801 to allow the pipe to vibrate without touching the walls of the slot. When the wheels of a vehicle impact the plate 803 of the sensor, the impact causes the pipe 801 to resonate and generate sharp sound impulses. This configuration can reduce wear and tear on the pipe for a longer usage of the sensor system particularly in a road having heavy volume traffic. To insure a good impact between plate 803 and the wheels of the moving vehicle, it is further advantageous to have the top surface of plate 803 textured by small protrusions 809 as seen in FIG. 12. The protrusion on a 3 mm thick plate might, for example, be 1–2 mm high. Alternatively, a small bump 811 may be formed in plate 803 as seen in FIG. 12. For example, the plate may be bent longitudinally to form a triangular bump about 2–10 mm in height and 4–20 mm in width at its base as shown in FIGS. 13A, 13B and 13C. The same methods of using multiple microphones and attaching the sensor to the pavement as were described for the embodiment shown in FIGS. 8A through 8D may be used for these embodiments.

Figure 14:
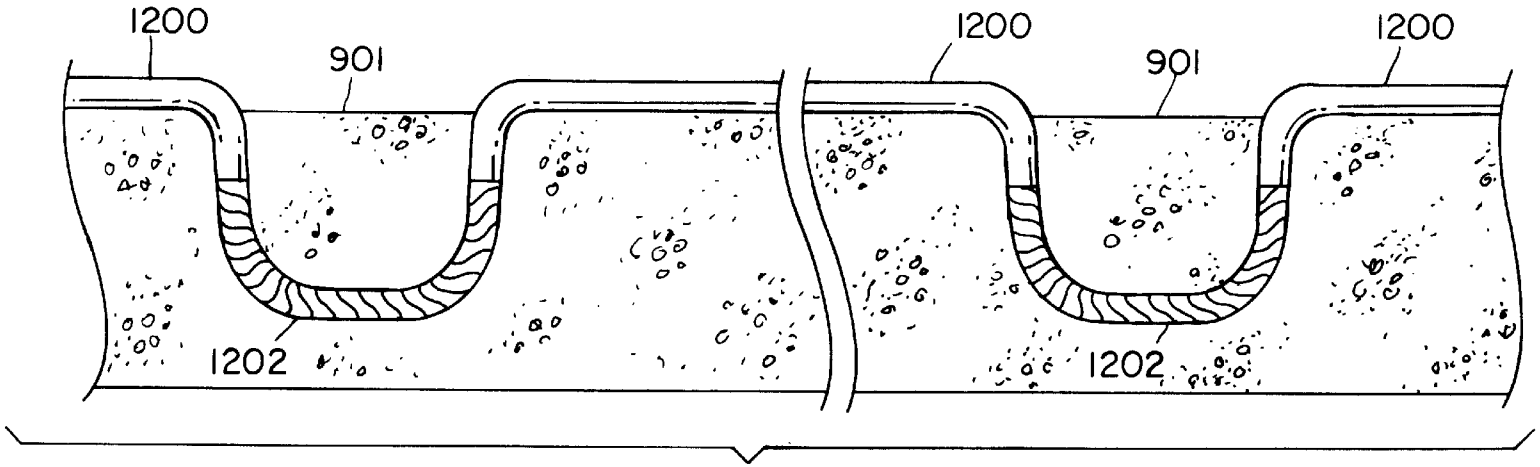

FIG. 14 illustrates another embodiment of the sensor housing structure, meant to add flexibility to the sensor to fulfill a need where the pavement surface 901 may be made "bumpy" by heavy traffic. The housing is divided into many smaller units 1200 whose individual length ranges between 20 cm and 100 cm, preferably about 40 cm. These segments 1200 are then connected by flexible pipe joints 1202, typically 20–30 cm long, that are embedded deep in the pavement, say 10 cm deep. The flexible pipe joints 1202 may be made of helical metal pipe, or such metal pipe coated with Teflon (TM) or PVC plastics. As a result of this design, any top surface movement may alter the appearance of the sensor housing, but will not cause it to pop out. This is a major concern particularly at intersections where heavy trucks stop and resume motion, thus exerting enormous forces on the pavement material, sometimes causing it to yield and deform, becoming bumpy.

The extra length of the flexible pipe joints 1202 allows the segments 1200 to shift sideways due to changes in the topography of the surface. Another reason for dropping the joints 1202 deep in the pavement is that they are markedly less robust than the solid segments 1200 and need to be protected from the abuse of the vehicles wheels. For this reason, the top flat sensor segments 1200 are in the form of a shallow "U" as shown in the figure.

Figure 15B:
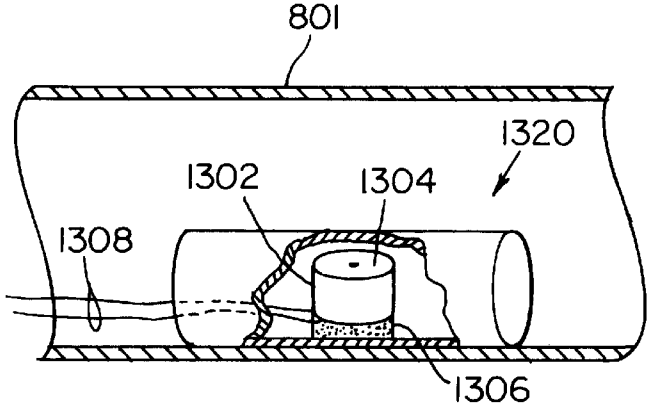
FIGS. 15A and 15B show two embodiments of a microphone used in the invention.
Figure 15A:
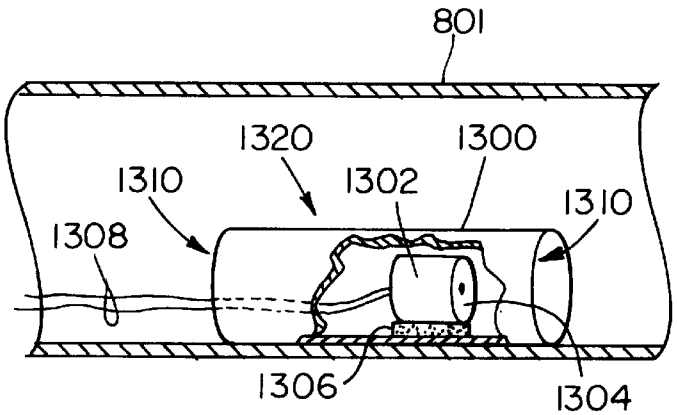

FIGS. 15A and 15B illustrate a microphone 1320 that is particularly efficient in the present invention, in that it is extremely insensitive to ordinary sound, i.e. acoustic airwaves, yet it is very sensitive to the vibrating pipe in which it is installed. As a result, the microphone virtually does not respond to vehicles passing unless they actually physically contact the sensor.

A small amount of fast-drying glue, such as CrazyGlue (TM) 1306 is placed on the inside of casing 1300 and microphone element 1302 is placed on the glue 1306 to hold the microphone element 1302 in place. FIG. 15A illustrates an embodiment in which the microphone membrane 1304 faces toward the end of the casing 1300, while FIG. 15B illustrates another embodiment in which the membrane 1304 faces the wall of the casing 1300. In either case, the leads 1308 of the microphone are extended beyond the casing, and the casing is then filled 1310 from both ends with epoxy. The completed assembly can then be inserted into the pipe such that it lies within the pipe as discussed above.

In the TELEM (Traffic Enhanced Law-Enforcement and Monitoring) system the velocity is simply determined as the ratio of the distance traveled between the two physical sensors, x, to the time interval elapsed between these two events, $\tau$. This assumes, of course a constant velocity over the distance x. Typically, this distance is set to be of the order of 1 meter. There is a good reason for keeping this distance small, so as to avoid any overlap of cars on the same set of sensors. However, the closer the distance the less accurate the measurements of velocity becomes. The absolute value of the error in determining the velocity has been calculated according to the standard definition, $$\Delta V \leqq (\Delta X/\tau)+(X\Delta\tau/\tau^2)$$

Needless to say, for a given level of uncertainty in measuring x and $\tau$, the lower the values of these parameters are, the higher would the uncertainty in the velocity V be.

Assume that the car is speeding while traversing the set of two sensors. Initially, the first axle crosses the set of two sensors and a first value for the car's average velocity, $V_0$, is determined upon the wheels disjoining the second sensor. Then, the same process is repeated for the second axle and an average value $V_1$ is determined. Between these two events a time differential, $\Delta t$, is measured (not to be confused with $\Delta\tau$, the uncertainty in time determination). Then, to a first approximation, the car's acceleration, a, during this time differential is then calculated by invoking the simple relation, $$V_1=V_0+a\Delta t$$

The distance between the two axles may now be determined. Assume S to denote this distance. We have the well known formula, $$(V_1-V_0)(V_1+V_0)=2aS$$

Since time, rather than acceleration, is the measured quantity we may substitute for the acceleration in the last equation by means of the preceding equation to obtain the very simple result:

$$S=(V_1+V_0)\Delta t/2$$

Obviously, if the car were not accelerating than the average velocity, $(V_1+V_0)/2$, would simply be replaced by the vehicles constant velocity. As noted above, these values for the acceleration and the axle separation distance are only approximate. More elaborate expressions for a precise determination may be obtained by considering the actual velocities involved, rather than the average quantities.

The distance between axles is a very important result. It means that the method is not only able to count the number of axles that a vehicle may have, but also determine the distance between each two consecutive axles. We have examined this proposition by performing actual measurements. In one case, for example, we determined the distance between the two axles of an Infiniti G20 passenger car to be 2.58 m. The actual distance according to the manufacturer is 2.55 m. This is a discrepancy of about 1%, an excellent result considering the fact that the measurement was done while the car was traveling at a speed of 50 Km/hr. We suggest that the TELEM system operating software will include a database of all known types of vehicles in current use in a given arena with the relevant axle separation distances. Then, upon measurements done, the system will be able to pinpoint the type of vehicle moving over the sensors and thus decide when the vehicle has cleared the sensor region and a photo be taken if necessary to document a violation event. This is an important point since different vehicles have different numbers of axles. Trucks, for example, may have as many as 7 axles.

The velocity measurements may also be used to determine the distance between following vehicles, the cause of twice as many accidents as speeding. The regarding following distance may now be unambiguously determined and the related regulation be enforced since the present system is able to determine the acceleration of both moving vehicles. Any claim by the operator of the second, following vehicle as regards a possible sudden drop in the velocity of the first vehicle would be scrutinized by the measured acceleration data.

While this invention has been particularly shown and described with references to preferred embodiments thereof, it will be understood by those skilled in the art that various changes in form and details may be made therein without departing from the spirit and scope of the invention as defined by the appended claims.

For example, the various embodiments of the integrated law enforcement system described above include different layouts and arrangements of the sensing elements used to determine various types of traffic law violations. It will be understood that other types of sensor layouts are possible for these and other similar applications. Also, the preferred embodiment of passive road sensor 10 in FIG. 1A was described with reference to a microphone as the sound sensitive device. It will be understood that other devices, and combinations thereof, that are sensitive to the energy released in a mechanical impact can be used in detecting and measuring the exact impact time.

What is claimed is:

1. A system for passively monitoring traffic flow and adherence to traffic laws and regulations comprising:

a passive road sensor comprising:

an acoustic signal generator installed in or on the road surface; and a detector to detect an acoustic signal generated from impact of wheels of a vehicle to the generator as the vehicle is driven over the generator and conducted through the generator to the detector.

2. A system as claimed in claim 1 wherein the acoustic signal generator comprises a pipe, the pipe also serving as a housing for the detector.

3. A system as claimed in claim 2, the pipe being positioned within an opening in the road which essentially spans the entire width of the road.

4. A system as claimed in claim 3 wherein the detector is a microphone.

5. A system as claimed in claim 2, the pipe being positioned on a surface of the road and essentially spanning the entire width of the road.

6. A system as claimed in claim 5 wherein the detector is a microphone.

7. A system as claimed in claim 2 wherein the detector is a microphone.

8. A system as claimed in claim 1 wherein the acoustic signal generator comprises:

a plurality of non-flexible housing segments of length between 20 cm and 100 cm, connected by flexible pipe joints between 10 and 50 cm long.

9. A system as claimed in claim 1 further comprising:

an integrated event recording and reporting system in direct communication with the passive road sensor comprising a processing unit, a video camera and a communication module, wherein the signal from the passive road sensor causes the processor unit to engage the video camera to capture an image of the passing vehicle and to communicate data corresponding to the image to a separate control unit by means of the communication module, whereupon the processing unit generates a report to a traffic law violation.

10. A system as claimed in claim 9 wherein signals from a plurality of passive road sensors are used to determine vehicle velocity and acceleration, relative distance between two vehicles, distance between axles of a single vehicle, and vehicle compliance with a traffic "stop" sign, a traffic "yield" sign, a solid line division in the road, and/or traffic lights.

11. A system as claimed in claim 1, the acoustic signal generator further including:

a metal plate rigidly fixed across a lane of a road; and a pipe, portions of which are rigidly attached to a surface of the plate such that remaining lengthy portions of the pipe are free to vibrate.

12. A system as claimed in claim 11 wherein the generator is invertably fixed to the road so that the pipe is embedded into a slot formed in the lane, the slot being sufficiently large to receive the pipe without touching the pipe.

13. A system as claimed in claim 12 wherein the top surface of the plate is roughened by small protrusions.

14. A system as claimed in claim 13 wherein the end of the pipe is hermetically sealed after inserting the detector.

15. A system as claimed in claim 13 wherein the detector comprises a plurality of microphones spaced about 1 meter apart inside the acoustic signal generator.

16. A system as claimed in claim 15 wherein each microphone comprises a microphone element enclosed within a casing, the casing being filled with epoxy.

17. A system as claimed in claim 12 wherein the top surface of the plate is bent to form a triangular protrusion about 2 to 10 mm in height and 4 to 20 mm in width at its base.

18. A system as claimed in claim 17 wherein the end of the pipe is hermetically sealed after inserting the detector.

19. A system as claimed in claim 17 wherein the detector comprises a plurality of microphones spaced about 1 meter apart inside the acoustic signal generator.

20. A system as claimed in claim 19 wherein each microphone comprises a microphone element enclosed within a casing, the casing being filled with epoxy.

21. A system as claimed in claim 11 wherein the end of the pipe is hermetically sealed after inserting the detector.

22. A system as claimed in claim 11 wherein the detector comprises a plurality of microphones spaced about 1 meter apart inside the acoustic signal generator.

23. A system as claimed in claim 22 wherein each microphone comprises a microphone element enclosed within a casing, the casing being filled with epoxy.

24. A system as claimed in claim 12 wherein the end of the pipe is hermetically sealed after inserting the detector.

25. A system as claimed in claim 12 wherein the detector comprises a plurality of microphones spaced about 1 meter apart inside the acoustic signal generator.

26. A system as claimed in claim 25 wherein each microphone comprises a microphone element enclosed within a casing, the casing being filled with epoxy.

27. A method of monitoring and recording traffic flow and traffic-law violation events comprising:

providing openings on a road;

providing passive road sensors, each including a sound detector enclosed within an enclosure, the enclosure being positioned within each road opening on the road, and the sensors in continuous communication with a remote control processing unit;

providing a video camera in line with the sensors to capture images of traffic flow events;

providing a communication module to pass images to the processing unit;

measuring vibrations caused by wheel impact of a moving vehicle with the road sensors to generate signals in the detectors, the signals triggering a computing process in a central processing unit to determine the nature of the traffic event; and activating an operating system in the processing unit to communicate with the road sensors to control the video camera and communication module, to automatically generate a report and citation to a traffic law violator.

* * * * *